US005791559A

United States Patent [19]

Fox et al.

[11] Patent Number: 5,791,559

[45] Date of Patent: Aug. 11, 1998

[54] TEMPORARY RAIL BRIDGE

[76] Inventors: Richard H. Fox, E. 1600 Sturgeon, Rathdrum, Id. 83858; David M. Steinbacher, 16520 N. Hamilton St.; Wesley L. Olin, E. 1012 Parkhill Dr., both of Spokane, Wash. 99208; Vernon O. Meyers, S. 1209 Raymond, Spokane, Wash. 99206; William J. Zimmerle, 387111 N. Jackson Rd., Elk, Wash. 99009

[21] Appl. No.: 801,266

[22] Filed: Feb. 19, 1997

[51] Int. Cl.[6] ..... E01B 11/00

[52] U.S. Cl. ..... 238/218; 238/220; 238/263

[58] Field of Search ..... 238/151, 218, 238/220, 243, 248, 230, 231, 235, 256, 263

[56] References Cited

U.S. PATENT DOCUMENTS

| | | | |
|---|---|---|---|
| 125,426 | 4/1872 | Yost . | |
| 477,694 | 6/1892 | Niles | 238/263 |
| 612,059 | 10/1898 | Rohlin . | |
| 1,059,263 | 4/1913 | Bennett | 238/263 |
| 1,133,694 | 3/1915 | Bacher . | |
| 1,252,275 | 1/1918 | Lorber . | |
| 1,378,425 | 5/1921 | Rosebrook . | |
| 1,429,431 | 9/1922 | Hruska . | |
| 1,581,405 | 4/1926 | Smith . | |
| 1,620,906 | 3/1927 | Maher | 238/220 |
| 2,143,766 | 1/1939 | Dill | 238/218 |
| 2,492,130 | 12/1949 | Yuschack | 238/218 |
| 2,539,650 | 1/1951 | Wirth | 238/218 |
| 2,722,384 | 11/1955 | Buhrer | 238/218 |
| 3,139,364 | 6/1964 | Fiechter | 238/511 |
| 5,024,380 | 6/1991 | Newman | 238/218 |

FOREIGN PATENT DOCUMENTS

| | | | |
|---|---|---|---|
| 41169 | 3/1887 | Germany | 238/263 |
| 155409 | 1/1904 | Germany | 238/220 |
| 628956 | 4/1936 | Germany | 238/151 |
| 840256 | 4/1952 | Germany | 238/263 |
| 364586 | 11/1938 | Italy | 238/220 |
| 709750 | 1/1980 | Russian Federation | 238/220 |

*Primary Examiner*—Mark Tuan Le
*Attorney, Agent, or Firm*—Stoel Rives LLP

[57] ABSTRACT

The temporary rail bridge (20) of the illustrated embodiment includes a bridge number (20) that is coupled to a track rail (16) by screw clamps (24). Each of the screw clamps (24) includes an internal tensioning component such as a spring (58) that allows for fast installation of the rail bridge (20) and maintains continuous pressure engagement in operation. The rail bridge (20) reduces track closure time due to rail damage and associated costs and inconvenience.

10 Claims, 6 Drawing Sheets

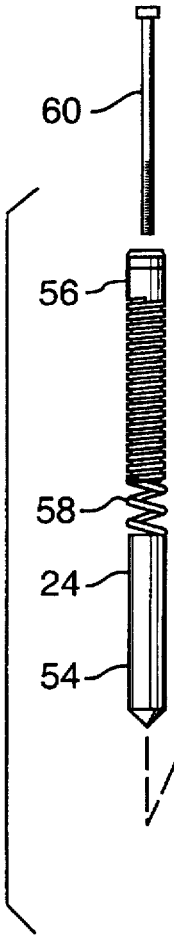
FIG. 3
FIG. 4
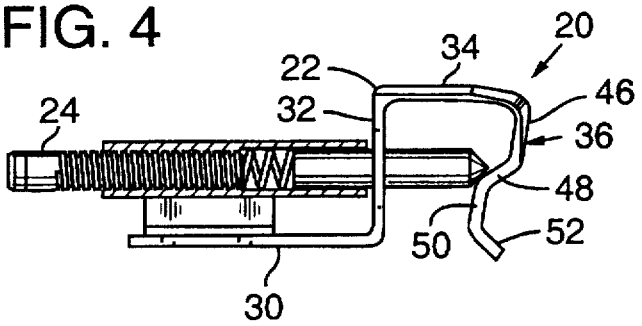
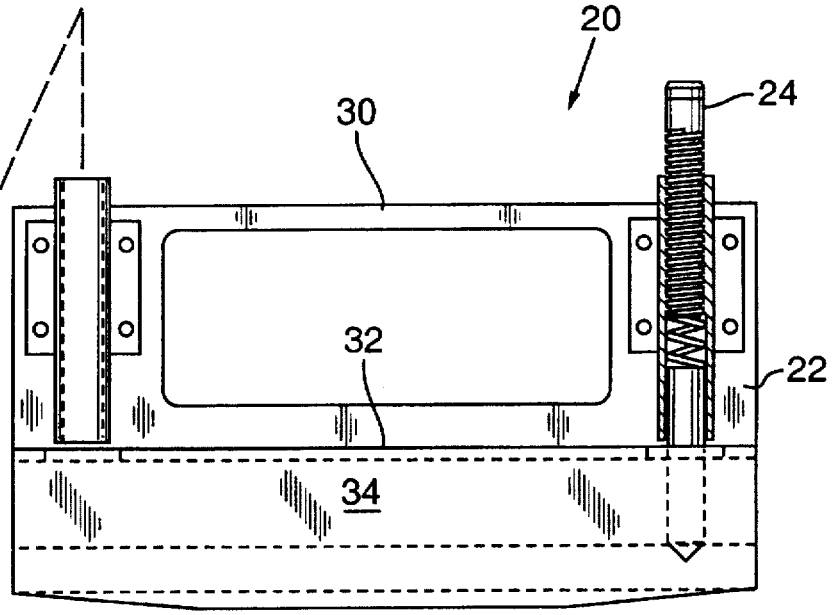
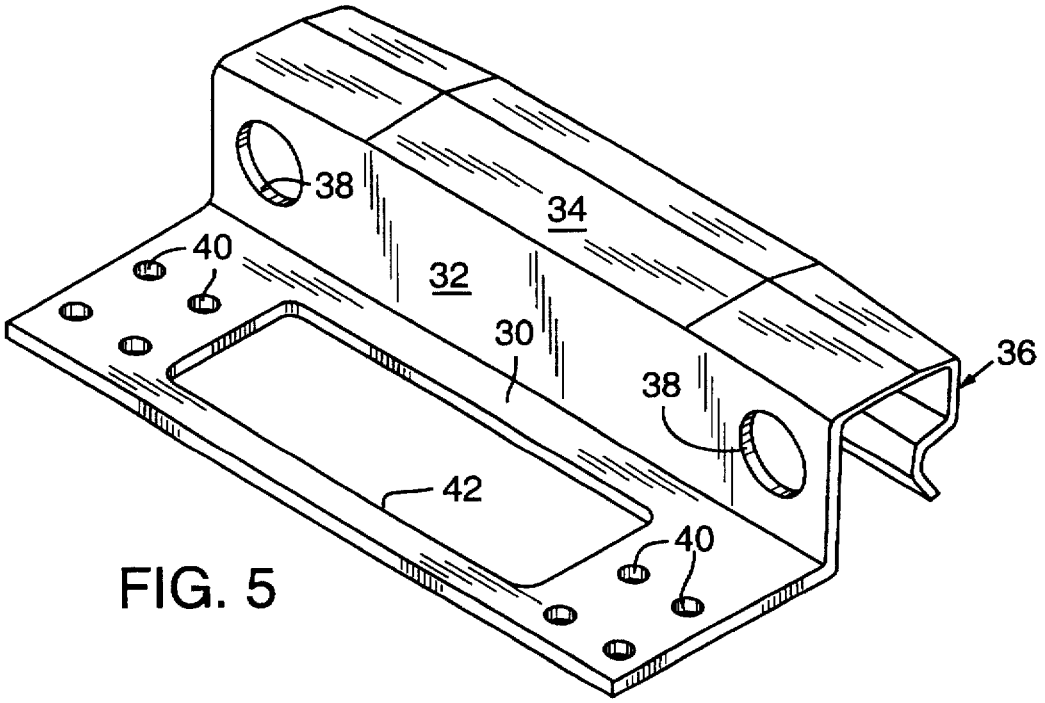
FIG. 5

TEMPORARY RAIL BRIDGE

FIELD OF THE INVENTION

The present invention relates to a temporary rail bridge for allowing passage over a damaged section of railroad track until a permanent repair can be made.

BACKGROUND OF THE INVENTION

In the rugged railroad environment, it is not uncommon for a section of track to become severed, cracked or otherwise damaged, often rendering the track impassible or unsafe. Currently, such a damaged track section must be closed to railroad traffic until a permanent repair can be made. The permanent repair entails moving the damaged section of track, transporting a new rail section to the location of the repair and installing the new rail section. In effect, the section of track is simply rebuilt.

This is a time consuming and labor intensive effort. The track is typically closed to traffic for at least several hours and can be impassable for days during the repair. This problem is compounded by service regulations regarding hours worked by train crews which may require crew changes due to the delay. As a result, train traffic congestion occurs, crew and transportation costs increase and the railroad customer satisfaction suffers. These problems have long troubled the industry. Unfortunately, the prior art has failed to provide a fully satisfactory solution in this regard.

SUMMARY OF THE INVENTION

The present invention is directed to a rail bridge for allowing passage over a damaged area of track until a permanent repair can be made. The temporary rail bridge can be installed quickly, thereby reducing track closure time and reducing the need for crew changes. The invention thereby reduces traffic congestion as well as crew and transportation costs.

According to one aspect of the invention, the temporary rail bridge includes a bridge member that extends across the damaged rail section and overlays the upper track surface on each side of the damaged section. In this regard, it will be appreciated that the track rail includes an upper support surface for bearing against the running surface of a railroad vehicle wheel and an inner side, or so-called gauge side, surface for bearing against a wheel flange. The bridge member includes a first portion in overlapping relationship with the upper support surface on a first side of the damaged section and a second portion in overlapping relationship with the upper support surface on a second side of the damaged section. Vehicle wheels are thereby supported across the damaged track section by the bridge member, even where the damaged section involves a significant gap in the track support surface.

In one embodiment, the bridge member is contoured to generally conform to the cross-section of the track rail. In particular, the bridge member includes a gauge side section that extends downwardly from an upper section of the bridge member on the gauge side. The gauge side section generally corresponds to the shoulder of the track rail for bearing against the flange of a vehicle wheel. In this embodiment, the bridge member further includes an inner side section extending downwardly from the upper section on the opposite rail side. The inner side section can be used for securing the bridge member to the track rail.

According to another aspect of the invention, the temporary rail bridge is secured to a track rail without the need to penetrate the track with a bolt, rivet or the like. The temporary rail bridge includes a bridge member and a pressure engagement element for bearing against an external surface of the track rail so as to effect a pressure engagement between the bridge member and the rail. In this manner, the bridge member can be quickly and securely mounted on the track rail, thereby minimizing track closure. Moreover, the bridge member can be easily removed when maintenance crews are available to make a permanent repair to the damaged rail section. The pressure engagement element preferably includes an internal tensioning mechanism, e.g., a spring or fluid cylinder, for urging the pressure engagement element against the rail so as to maintain substantially continuous contact.

In one embodiment, the pressure engagement element includes a pair of spring-loaded screw clamps mounted on the bridge member. The bridge member is installed by positioning the bridge member over the damaged rail section so that one of the screw clamps is located on each side of the damaged section. A threaded element of each of the screw clamps is then rotated to compress an internal spring that, in turn, presses a contact member against the rail. Optionally, additional engagement elements (e.g., two elements on each side of the damaged track section) can be employed to more securely fasten the bridge element to the rail, or to accommodate higher traffic speeds over the bridge.

The invention thus allows railroad traffic to pass over a damaged track section prior to completing a permanent repair. The temporary rail bridge of the present invention can be installed in less than an hour, thus minimizing track closure and greatly reducing attendant costs and inconvenience.

BRIEF DESCRIPTION OF THE DRAWINGS

For a more complete understanding of the present invention and further advantages thereof, reference is now made to the following detailed description taken in conjunction with the drawings, in which:

FIG. 3 is a top view, partially exploded, showing the temporary rail bridge of FIG. 2;

FIG. 4 is an end view showing the temporary rail bridge of FIG. 2;

FIG. 5 is a perspective view showing the bridge member of the temporary rail bridge of FIG. 2;

DETAILED DESCRIPTION OF THE INVENTION

Figure 1:
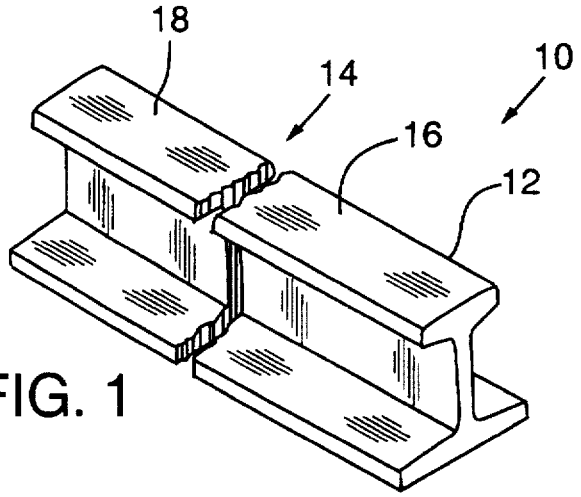
FIG. 1 shows a railroad track including a damaged rail section.

Due to the severe stresses of the railroad environment, track rails occasionally crack, break or otherwise become damaged. FIG. 1 generally illustrates a track 10 where one of the rails 12 includes a damaged section 14 bounded by first and second rail portions 16 and 18 that remain intact. It is not uncommon for the damaged rail section to extend up to 6 inches or more. Such rail damage can render the track 10 impassable to rail traffic and result in significant delay and expense as discussed above.

The present invention, as set forth below, allows for fast, temporary repair of the track so as to greatly reduce the problems associated with rail damage.

Figure 2:
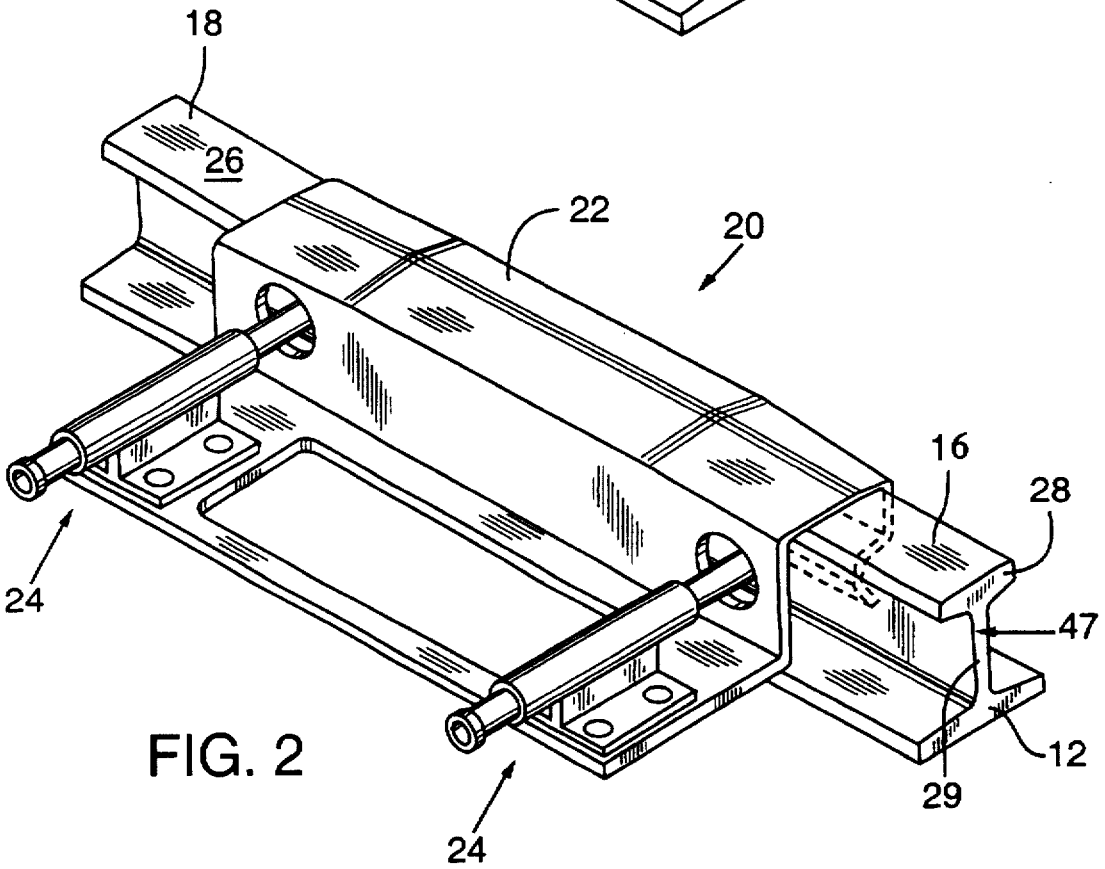
FIG. 2 is a perspective view of a temporary rail bridge, constructed in accordance with the present invention, installed on a track rail.

FIGS. 2 through 4 illustrate a temporary rail bridge 20 constructed in accordance with the present invention. Generally, the temporary rail bridge 20 includes a bridge member 22 and spring-loaded screw clamps 24 for securing the bridge member 22 to the rail 12. The bridge member 22 extends over the damaged section 14 of the track 10 from intact portion 14 to intact portion 16. More particularly, the bridge member 22 overlies the upper surface 26 and extends around the upper gauge side flange 28 of intact portions 14 and 16. As will be described in greater detail below, the screw clamps 24 effect a pressure engagement against the opposite side 29 of rail 12 so as to secure the temporary rail bridge 20 to the rail 12.

Various details of the bridge member 22 are shown in FIGS. 5–8. The bridge member 22 is constructed from materials sufficiently sturdy to support a railroad vehicle wheel across short sections where the track may be completely absent. Although other materials may be satisfactory in this regard, the illustrated bridge member 22 is constructed from alloy steel ⅜" thick. Stainless steel can also be used in construction the bridge member 22. The illustrated bridge member 22 preferably has a length of approximately 1–4 feet and is contoured to generally match the shape of the rail 12 to which it is applied. Generally, the bridge member 22 includes a base 30, sidewall 32, an upper wheel bearing surface 34 and a gauge side wheel bearing surface 36.

As shown, a number of openings are formed in the bridge member 22. Sidewall openings 38 provide access for the screw clamps 24 (FIG. 2) to engage the rail 12. Base openings 40 are provided for mounting of the screw clamps 24 on the bridgemember 22. A large central opening 42 is provided in the illustrated embodiment to allow placement over thermite welds.

Figures 6, 7:
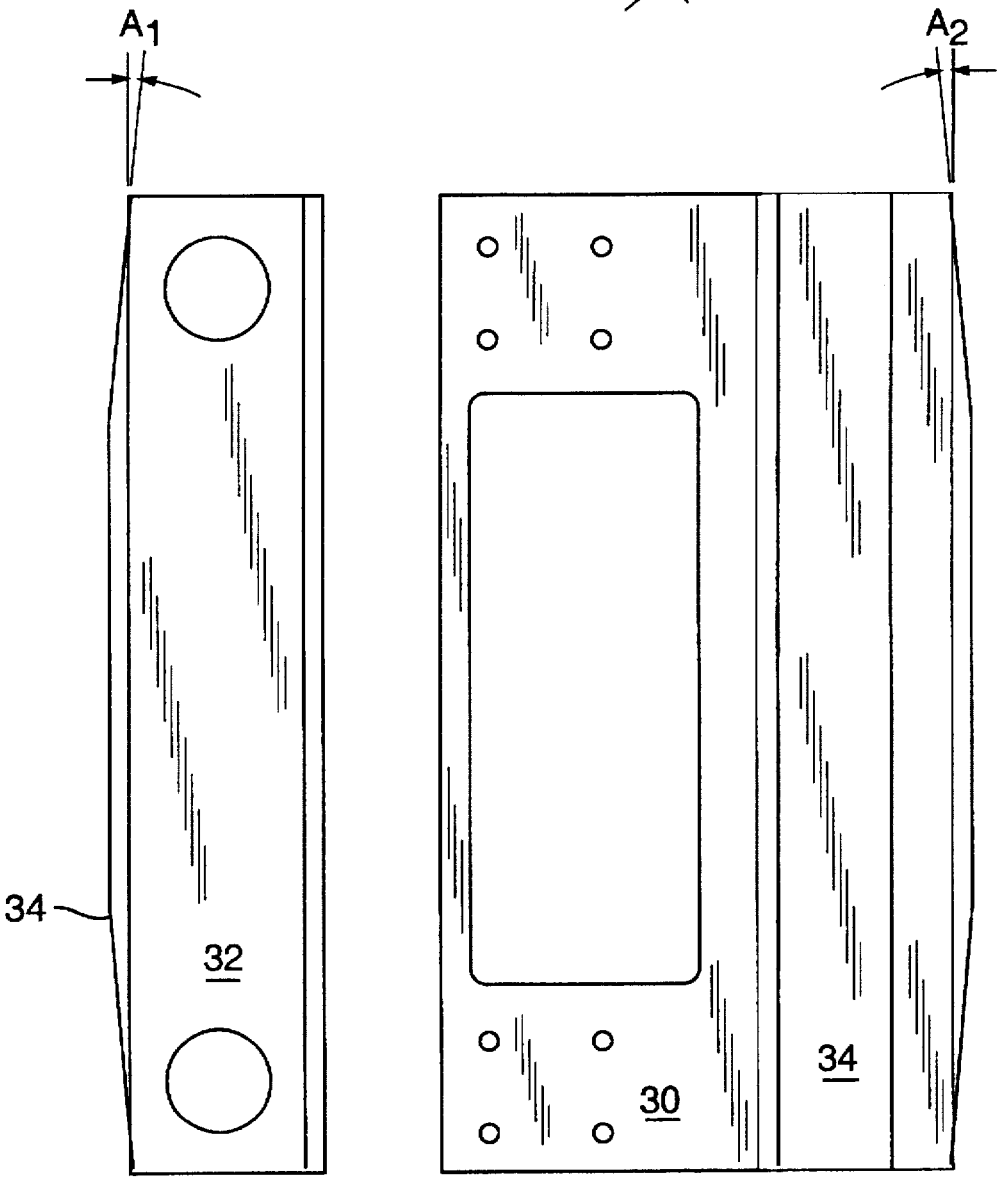
FIG. 6 is a top view of the bridge member of FIG. 5.
FIG. 7 is a side view of the bridge member of FIG. 5.

As shown most clearly in FIGS. 6 and 7, the upper wheel bearing surface 34 and gauge side wheel bearing surface 36 are tapered at the end sections of the bridge member 22 to provide a smooth rail/bridge transition and reduce wear on the bridge member 22. In this regard, the upper surface taper angle, $A_1$, and the gauge surface taper angle, $A_2$, are both preferably less than about 9 degrees. In the illustrated embodiment, $A_1$ is about 2 degrees and $A_2$ is about 4 degrees.

Figure 8:
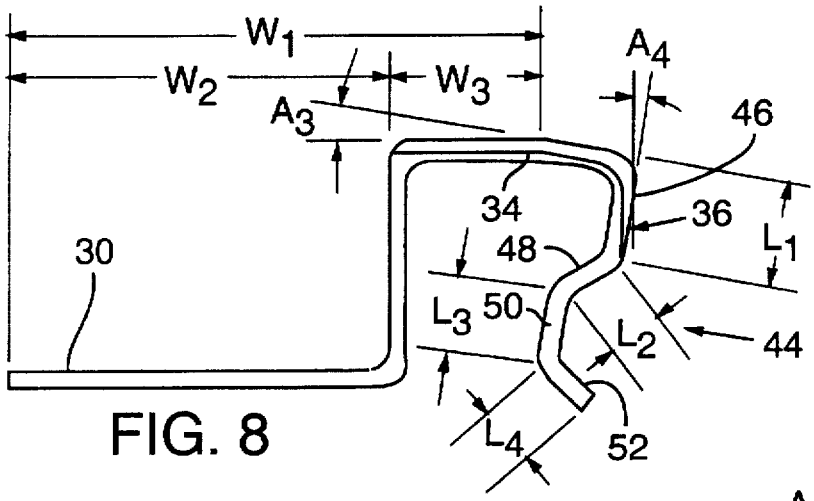
FIG. 8 is an end view of the bridge member of FIG. 5.

Additional geometric aspects of the bridge member 22 are shown in FIG. 8.

In order to provide improved track/bridge member mating at the wheel bearing surfaces, a portion of the upper surface 34 is angled at angle $A_3$ relative to the remaining portion of the surface 34. The upper portion 46 of gauge side surface 36 is is formed at a substantially right angle to the angled portion of the upper surface 34. It will thus be appreciated that the upper portion 46 of gauge side surface 36 is disposed at an angle $A_4$ (substantially equal to $A_3$) relative to sidewall 32. In the illustrated embodiment, $A_3$ and $A_4$ are about 9 degrees. The gauge side surface 36 also includes an inwardly extending curved portion 44 for bearing against the web 47 (FIG. 2) of rail 12. The internal spring tension of the bridge member 22 as thus formed, in combination with the pressure exerted by screw clamps 24, has been found to maintain secure and substantially continuous contact between the rail 12 and the wheel bearing surfaces of bridge member 22 even as forces vary dramatically due to movement of a series of vehicle wheels across the temporary rail bridge 20.

The dimensions of the illustrated bridge member 22 accommodate a variety of rail sizes including permanent rail sizes ranging from at least 80 to 140 pounds, and may include head free or "T" rails. The illustrated bridge member 22 has an overall width $W_1$ of 12⅞" including a base member width $W_2$ of 7⅞" and a width $W_3$ of 3⅛" for the unangled portion of upper surface 34. The height H of bridge member 22 is about 5". The upper portion 46 of gauge side surface 36 has a length $L_1$ of about 2¼". The curved portion 44 of surface 36 is composed of first slope segment 48 (having a length $L_2$ of about 1¼"), landing segment 50 (having a length $L_3$ of about ⅝") and second slope segment 52 (having a length $L_4$ of about 1 1/16"). The angles between upper portion 46 and first segment 48, between segments 48 and 50, and between segments 50 and 52 can all be on the order of 50 to 55 degrees in the specifically illustrated embodiment. The bridge number 22 can be adapted to high and low sides of curves and tangent track rail.

Figure 9:
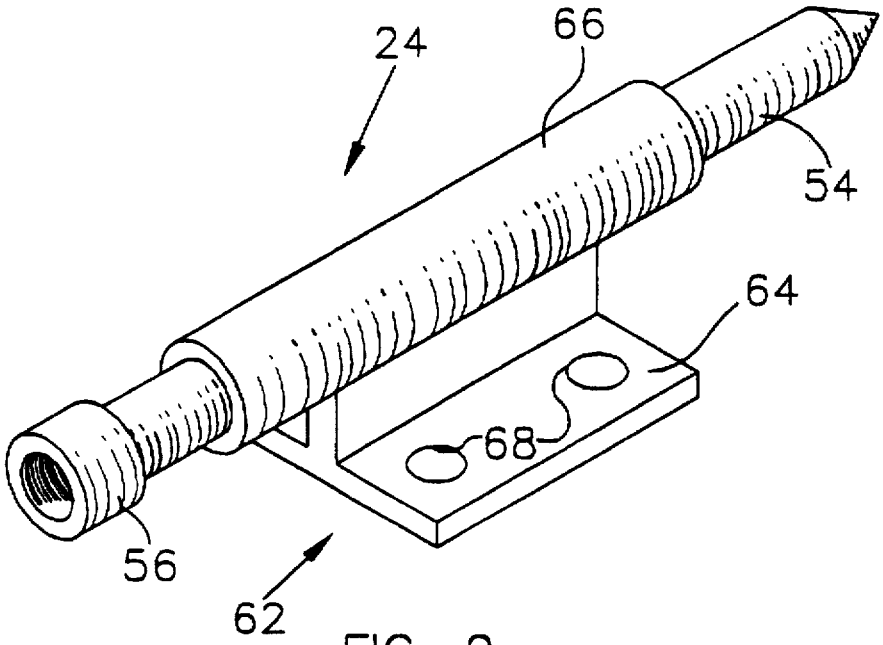
FIG. 9 is a perspective view of a screw clamp of the temporary rail bridge of FIG. 2.
Figure 10:
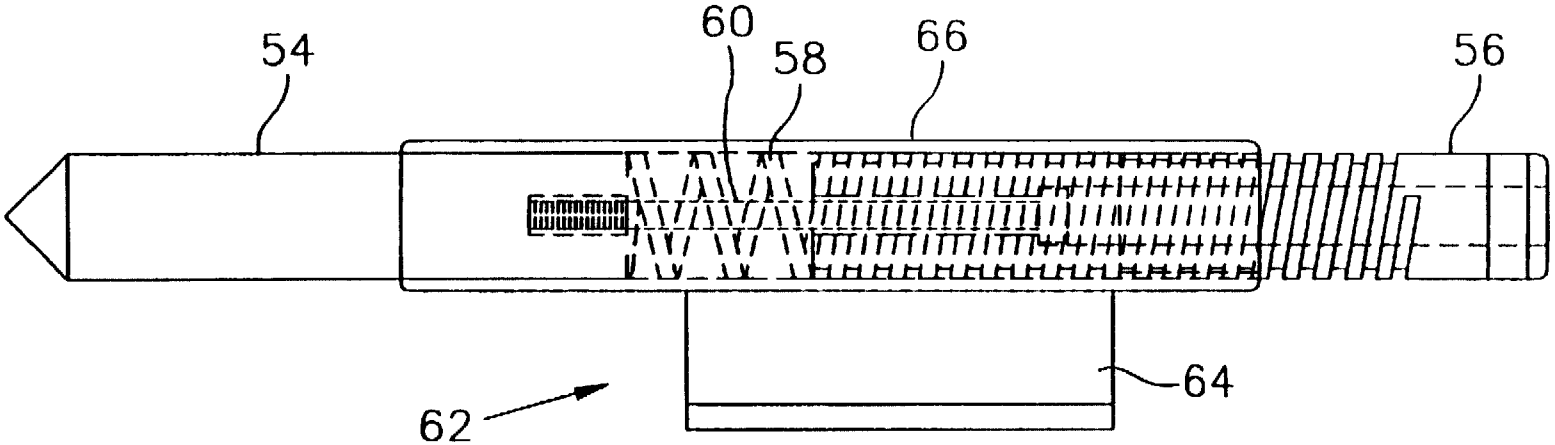
FIG. 10 is an end view of the screw clamp of FIG. 9.

Details of the screw clamps 24 can be seen in FIGS. 3 and 9-10. Each clamp 24 includes a rail contact 54, a tension bolt 56, an internal spring 58, compressed between the rail contact 54 and the tension bolt 56, and an allen head retainer bolt 60. The retainer bolt 60 is received within an internal axial bore of the tension bolt 56 and is threaded into a threaded bore of rail contact 54. In this manner, the retainer bolt 60 holds together screw clamp 24 and slightly compresses spring 58. The allen head of retainer bolt 60 can be readily accessed by an allen wrench via the axial bore of tension bolt 56. Spring 58 can be, for example, a 300–400 pound spring. Rail contact 54, which may be constructed from steel, is angled at its forward end to form a blunt point for bearing against the web 47 of rail 12. The rail contact 54 thus effects a pressure engagement with the rail 12 that is sufficient to fixedly secure the temporary rail bridge 20 to the rail 12 substantially without requiring bolting or other penetration through the rail 12. Although the illustrated contact 54 does not penetrate entirely through the rail, the contact may dimple the rail surface to a depth of about 2–3 mm.

A mount 62 secures each of the screw clamps 24 to the base 30 (FIG. 5) of bridge member 22. The mount 62 includes a base 64 and a mounting sleeve 66. Openings 68 in base 64 allow for attachment of the mount base 64 to the bridge member base 30 using bolts, screws, rivets or the like. The bases 64 and 30 may also be welded together if desired. The illustrated mounting sleeve 66 has an inside diameter of about 1" and is at least partially threaded to engage a threaded exterior portion of the tension bolt 56.

As an alternative to the illustrated screw clamps, other types of clamping devices may be utilized. For example, the clamping system can be powered by hydraulic cylinders with a manual pump. Other clamping arrangements will be apparent upon consideration of the present description. Moreover, the clamping system may be engaged with the bottom surface of the rail, as well as the side surface.

In operation, the temporary rail bridge 20 can be assembled and installed as follows. The tension bolt 56, spring 58 and rail contact 54, respectively, are arranged in series and are held together by retainer bolt 60 due to the threaded engagement with the rail contact 54. The tension bolt 56 is retained within the sleeve 66 of mount 62 by threaded engagement therebetween. The mount 62 is bolted or otherwise secured to the base 30 of bridge member 22. It will be appreciated that the various assembly steps thus entailed can be conducted in any suitable sequence.

The assembled temporary rail bridge 20 is installed on rail 12 by placing the bridge member 22 over the damaged rail section 14 so that the screw clamps 24 engage the opposite side 29 of the rail web 47 at intact portions 14 and 16 of rail 12. The clamps 24 and curved portion 44 of bridge member 22 thus engage the rail web 47 in opposing relation. To secure the temporary rail bridge 20 to the rail 12, a conventional wrench is used to progressively thread tension bolt 56 through sleeve 66 until the rail contact 54 makes contact with the rail web 47 (if contact has not already been established due to the action of spring 58). The tension bolt 56 is then threaded an additional distance to compress the spring 58 to a deflection that is preferably within the spring's substantially linear response deflection range. Tension bolt 56 is interchangeable. If desired, appropriate tension bolt markings or a torque wrench can be utilized for calibration in this regard. In the case of signal controlled tracks, a jumper cable can be clamped to the other permanent rail to allow correct track signal indication.

The temporary rail bridge 20 can be installed by one person. Thus, other members can attend to the many other repair and other services required when a train cannot proceed on its scheduled route.

The temporary rail bridge 20 as thus installed allows railroad vehicles to pass over the damaged section 14 of the track 10 until a permanent repair can be made. With the two clamp temporary rail bridge 20 as illustrated, it is anticipated that traffic may safely pass at speeds of about 5–10 miles per hour or more depending on various factors. Higher speeds and/or heavier loads may be accommodated by use of more clamps. The invention thus greatly reduces track closure times and associated expense and inconvenience resulting from the lack of temporary repair which has heretofore been unavailable.

Figure 11:
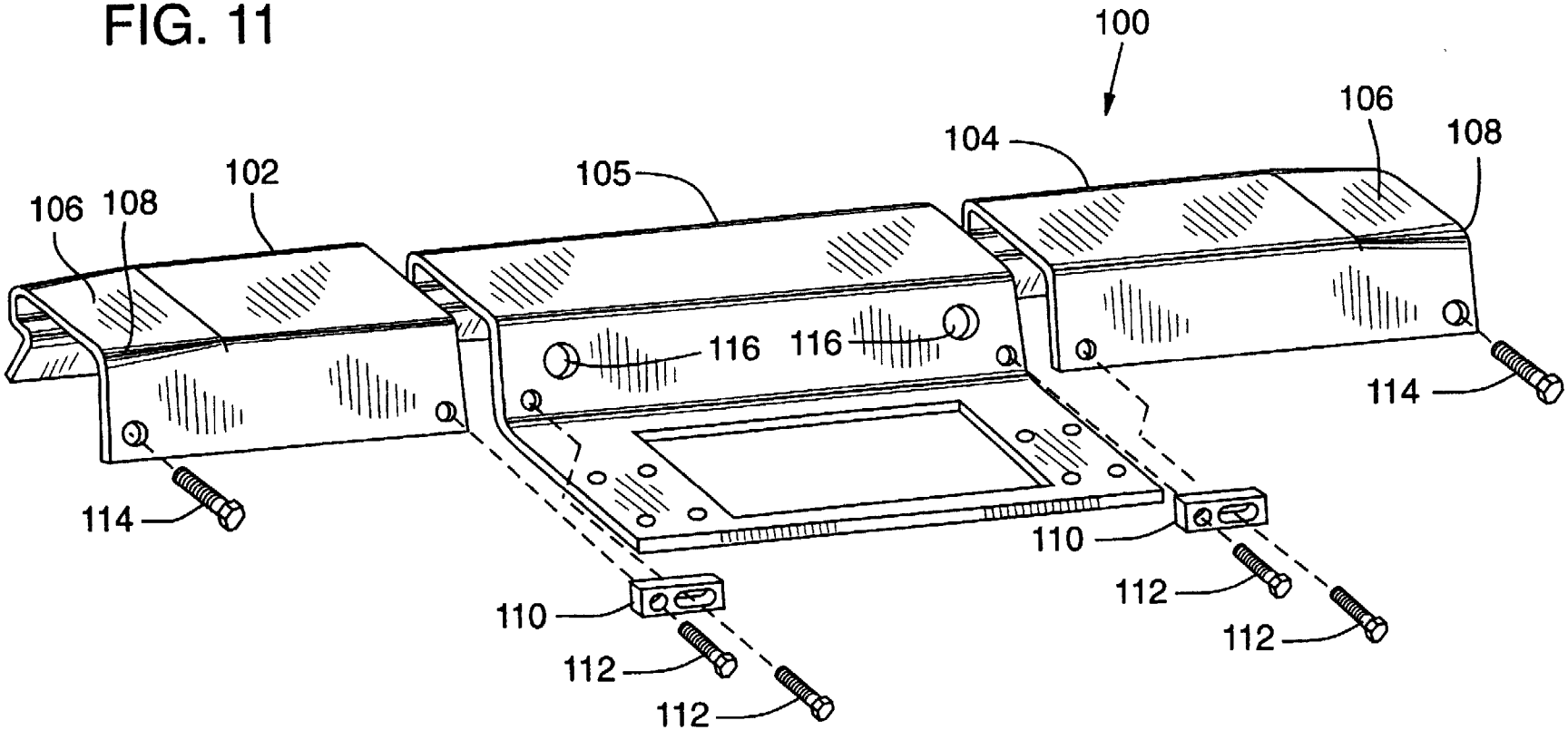
FIG. 11 shows an alternate embodiment of the temporary rail bridge of the present invention.

FIG. 11 shows an alternative rail bridge 100 constructed in accordance with the present invention. The bridge 100 is constructed in three parts including ramps 102 and 104 and a central spanning section 105. The illustrated ramps 102 and 104 are generally identical in construction although they have mirror image geometries to function as left and right approach ramps, respectively. In this regard, each ramp 102 and 104 includes an upper tapered section 106 and an inner tapered section 108 for facilitating a smooth transition of railcar wheels onto the bridge 100 from adjacent track. It will be appreciated that the ramps 102 and 104 will be subjected to large forces during use and may begin to wear over time. The illustrated three part construction allows for independent replacement of each of the ramps 102 or 104 as required, thereby reducing repair or replacement costs. The illustrated rail also includes brackets 110 (that are secured to the bridge 100 by bolts 112) for attaching the ramps 102 and 104 to the spanning section 105, thereby holding the ramps 102 and 104 in a fixed position relative to the spanning section 105. In addition, end bolds 114 are used to hold the ramps 102 and 104 in place at the ends thereof. The bridge 100 can be attached to the rail by spring clamps, such as described above, inserted through openings 116.

While various aspects and embodiments of the present invention have been described in detail, it is apparent that further modifications and adaptations of the invention will occur to those skilled in the art. However, it is to be expressly understood that such modifications and adaptations are within the spirit and scope of the present invention.

We claim:

1. An apparatus for use in bridging a damaged section of a railroad track rail which has a rail head connected to a rail web, the rail head including an upper surface for bearing against wheels of a railroad vehicle, an inner side surface for bearing against a flange of the railroad vehicle wheels, and an outer side surface, the apparatus comprising:

a unitary bridge member having opposed first and second ends with a central portion therebetween for extending longitudinally in an overlapping manner across the damaged section of the track rail, an inner portion for overlapping the inner side surface of the track rail, and an outer portion for overlapping the outer side surface of the track rail, the outer portion including a base extending away from the track rail, the inner portion having a curved portion of uniform thickness configured to create an internal spring tension when the curved portion bears against the rail web; and a clamp member fixed to the base for coupling the bridge member to the track rail so as to maintain the bridge member in a substantially fixed longitudinal position relative to the track rail.

2. The apparatus of claim 1, wherein the bridge member is contoured to generally correspond to a cross-section of the track rail.

3. The apparatus of claim 1, wherein the thickness of the central portion is tapered at the first and second ends in a direction toward the track rail to provide a smooth transition for vehicle wheels from the track rail to the bridge member.

4. The apparatus of claim 3, wherein the thickness of the inner portion of the bridge member is tapered in a direction toward the track rail at the first and second ends to provide a smooth transition for vehicle wheels from the track to the bridge member.

5. The apparatus of claim 1, wherein said clamp member is located, at a first end of the bridge member and a second clamp member is located at a second end of the bridge member.

6. The apparatus of claim 5, wherein the curved portion has angled portions extending toward the track rail to produce the internal spring tension in the bridge member.

7. The apparatus of claim 6, wherein each said clamp member has a contact end for bearing against the track rail to exert pressure against the track rail without substantially penetrating its surface, wherein the pressure exerted by the clamp members and the internal spring tension of the bridge member combine to maintain secure and substantially continuous contact between the track rail and the vehicle wheel as forces applied to the bridge member vary.

8. The apparatus of claim 7, wherein each clamp member includes an internal tensioning member for urging its respective clamp member against the track rail to maintain continuous pressure against the track rail.

9. The apparatus of claim 1, further including a first extension member having an upper surface for engagement with the vehicle wheel, the first extension member further having a connection end for attachment to one of the first and second ends of the bridge member and an opposite end in which the upper surface is tapered toward the track rail to ensure smooth transition for vehicle wheels from the track rail to the bridge member.

10. The apparatus of claim 9, including a second extension member having an upper surface for engagement with the vehicle wheel, the second extension member further having a connection end for attachment to the other of the first and second ends of the bridge member and an opposite end in which the upper surface is tapered toward the track rail to ensure smooth transition for vehicle wheels from the track rail to the bridge member.

* * * * *